United States Patent [19]

Rammos

[11] Patent Number: 5,061,943

[45] Date of Patent: Oct. 29, 1991

[54] PLANAR ARRAY ANTENNA, COMPRISING COPLANAR WAVEGUIDE PRINTED FEED LINES COOPERATING WITH APERTURES IN A GROUND PLANE

[75] Inventor: Emmanuel Rammos, Oegstgeest, Netherlands

[73] Assignee: Agence Spatiale Europenne, France

[21] Appl. No.: 388,098

[22] Filed: Jul. 31, 1989

[30] Foreign Application Priority Data

Aug. 3, 1988 [FR] France ..... 88 10501

[51] Int. Cl.[5] ..... H01Q 1/38; H01Q 21/00

[52] U.S. Cl. ..... 343/770; 343/776; 343/778; 343/789; 343/829

[58] Field of Search ..... 343/700 MS, 816, 770, 343/778, 776, 767, 789, 771, 829

[56] References Cited

U.S. PATENT DOCUMENTS

| | | | |
|---|---|---|---|
| 4,063,246 | 12/1977 | Greiser | 343/700 MS |
| 4,291,312 | 8/1979 | Kaloi | 343/700 MS |
| 4,486,758 | 12/1984 | de Ronde | 343/700 MS |
| 4,719,470 | 5/1985 | Munson | 343/700 MS |

FOREIGN PATENT DOCUMENTS

| | | |
|---|---|---|
| 0253128 | 1/1988 | European Pat. Off. . |
| 98201 | 4/1988 | Japan . |

OTHER PUBLICATIONS

Conference Proceedings, 12th European Microwave Conference, Helsinki 13-17 Sep. 1982, pp. 478-482, Microwave Exhibitions Ltd.

Electronics Letters, vol. 18, No. 6, Mar. 1982, pp. 252-253, London, GB; E. Rammos.

*Primary Examiner*—Michael C. Wimer

*Attorney, Agent, or Firm*—Andrus, Sceales, Starke & Sawall

[57] ABSTRACT

A planar antenna of the kind comprising feed lines disposed in a flat circuit and cooperating by hyperfrequency coupling with a metal ground plane plate pierced by apertures has the feed lines presenting a termination juxtaposed with each aperture. A lower ground plane plate is disposed at a distance of approximately a quarter wavelength from the apertured metal plate. The apertured metal plate comprises a metal coating deposited on a dielectric substrate. The feed line comprise central conductors disposed in channels which open into the apertures. The array of apertures, channels and conductors can be produced on the dielectric substate by single face printed circuit techniques. The antenna may be used for the reception of direct broadcasts from satellites.

19 Claims, 16 Drawing Sheets

FIG.1
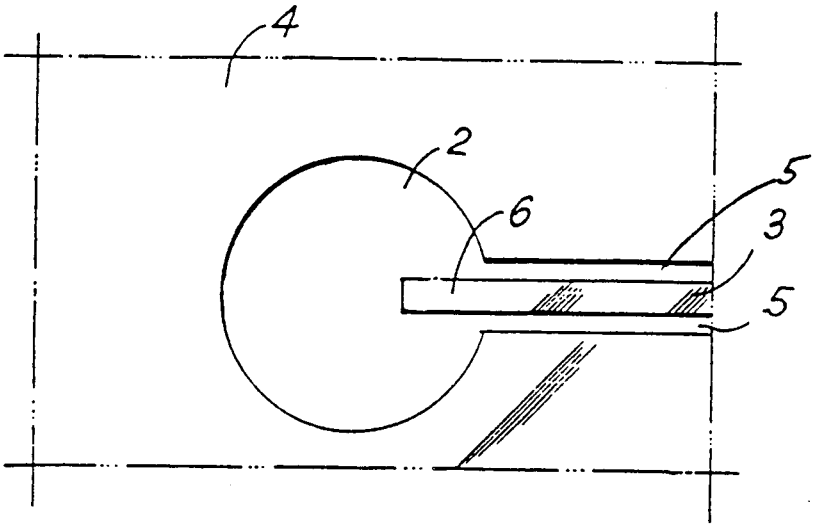
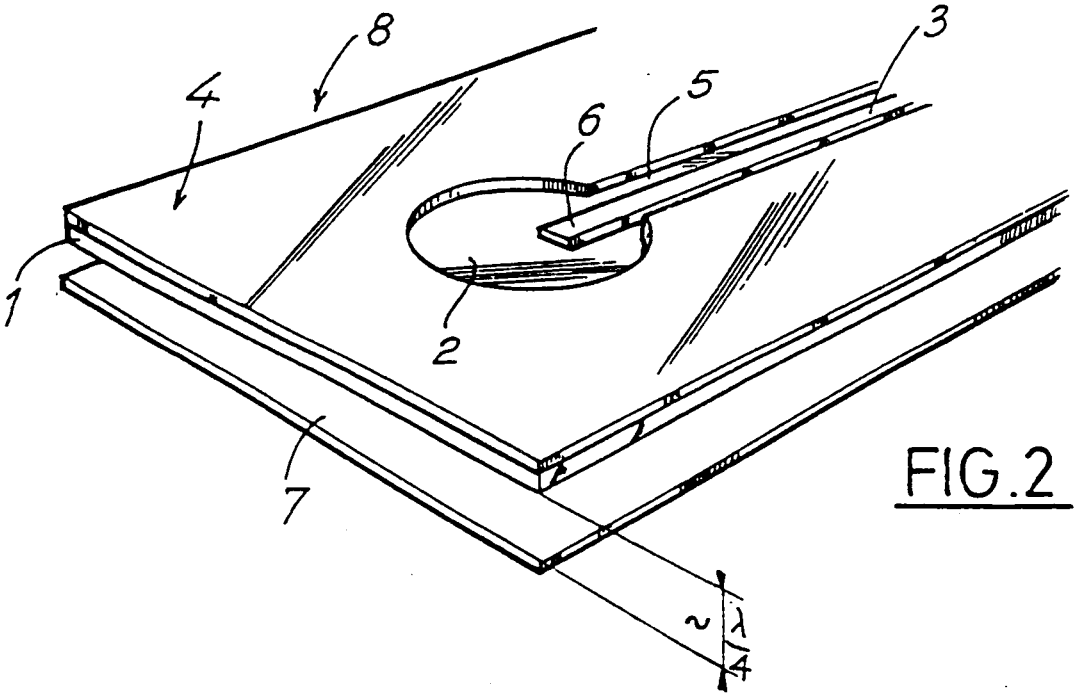
FIG.2
FIG.3
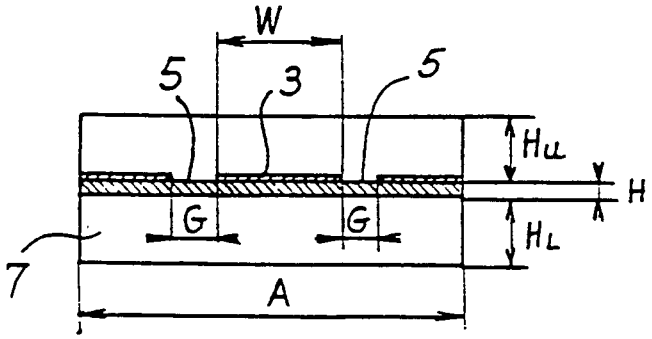

FIG.15
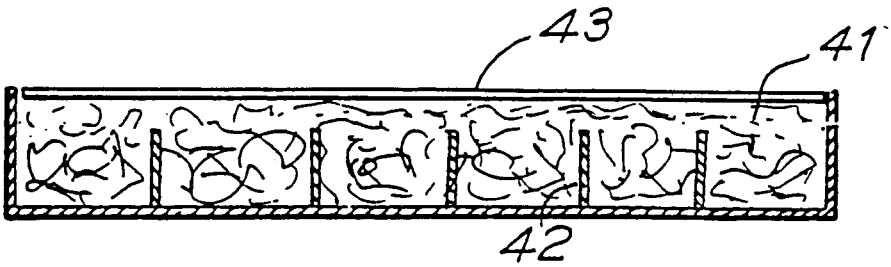
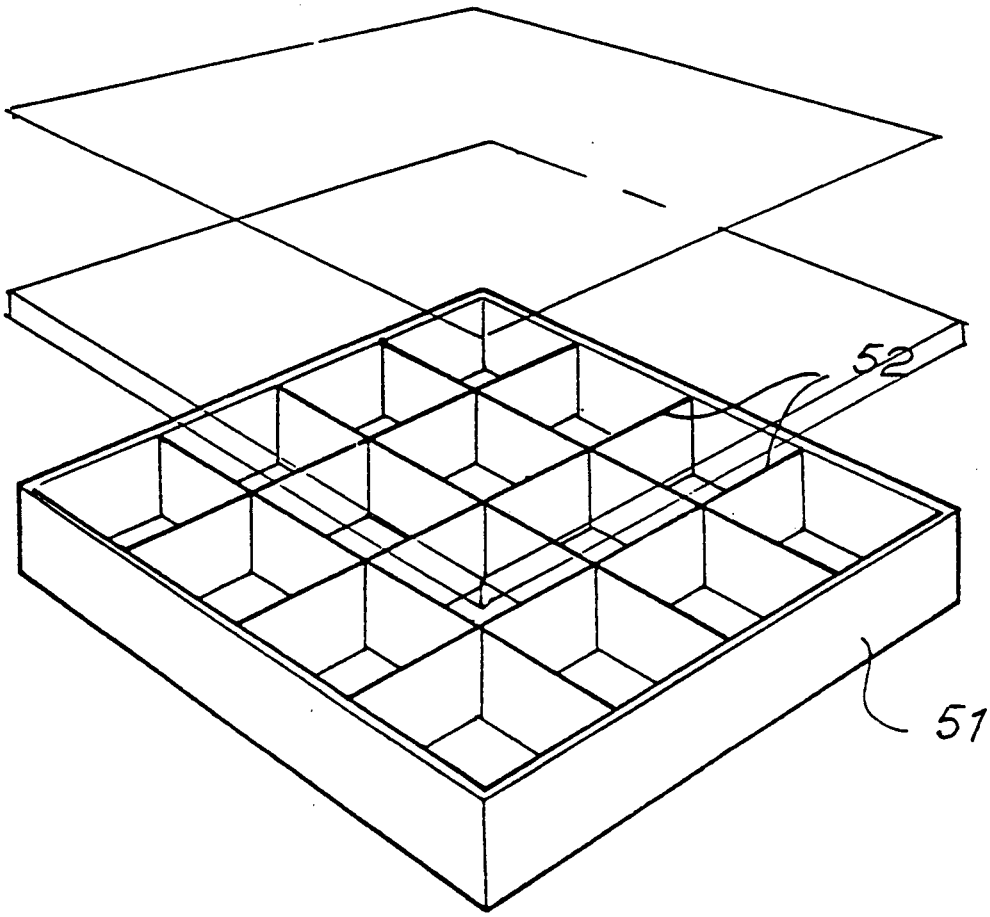
FIG.16

PLANAR ARRAY ANTENNA, COMPRISING COPLANAR WAVEGUIDE PRINTED FEED LINES COOPERATING WITH APERTURES IN A GROUND PLANE

BACKGROUND OF THE INVENTION

This invention relates to a planar array antenna comprising elements including waveguide feed lines disposed in a planar circuit and cooperating in electromagnetic coupling with a coplanar metal sheet having apertures, the feed lines having terminations juxtaposed to the apertures, and a reflecting lower conductive ground plane being disposed parallel to the coplanar circuit and sheet.

DESCRIPTION OF THE PRIOR ART

A goal of antenna technology has always been to produce a planar array antenna by printed circuit techniques together with its feed network on a thin, unique dielectric layer and having good performance. A first attempt to attain this goal was a printed microstrip patch antenna.

Unfortunately, the performance of patch array antennas made by printed circuit techniques has always been limited due to a compromise imposed on substrate thickness: a thick substrate was required for improving bandwidth and radiation efficiency, but a thin substrate was required for better impedance control, low spurious radiation and low feed line losses.

In order to avoid this problem, various solutions have been proposed, consisting of decoupling the feed line from the radiation microstrip element.

For example electromagnetic coupling of patches or dipoles has been proposed but, in these proposals, it is not possible to print everything on one single side of the dielectric substrate, which then requires precise alignment and more costly processing.

The book "Microstrip Patch Antennas" by I. J. Bahl and P. Bartia published in ARTECH 1980 describes printed slot radiators in a stripline structure which present a wider bandwidth than patch radiators but again the feed lines are not printed on the same single side of the dielectric and it is necessary to provide two dielectric layers.

Also, the impedance of a stripline feed depends on the spacing between the ground planes and so do slot efficiency and bandwidth, and a compromise is again required.

In addition to the above performance limitations, a major drawback of prior art printed patch or slot antennas resides in the need to use a low loss, high performance dielectric; such a dielectric is expensive.

For Direct Broadcasting by Satellite ("DBS") applications, such as TV receive only ("TVRO") antennas, the need for an expensive dielectric is unacceptable; for such a consumer market, low cost is essential. This was a main reason why flat plate antennas have not been used in TVRO applications.

However, some solutions have been proposed for this problem. A first solution comprises an array of coaxial transmission lines of the suspended stripline kind described in French Patent Application No. 83 06 650 of Apr. 22 1983; in this proposal, the transmission lines were printed on a thin, low quality dielectric suspended between two plates forming waveguide aperture radiators. However, the thickness of these metal plates is about 1 cm at a frequency of 12 GHz and they are difficult and expensive to manufacture. It has also been proposed to use metallized moulded plastic plates: this reduces the cost but does not solve the problem.

An improved cheaper solution has been proposed in French Patent No. 86 08 106 of June 5 1986 and its Patents of Addition No. 87 00 181 of Jan. 9 1987 and No. 87 15 742 of Nov. 13 1987, entitled "Planar Array Antenna, comprising a low loss printed feed conductor and incorporated pairs of wide band superimposed radiation slots". In this proposal, dual slot radiators are excited by suspended striplines whose central conductors are printed on a dielectric support plate suspended with low tolerance between two stamped metal ground planes; this feed network can be printed on a low quality inexpensive dielectric.

The performance of this array antenna is very good but a large part of the total cost of the antenna again comes from the manufacture of the stamped metal ground planes.

OBJECTS OF THE INVENTION

An object of the present invention is to provide a planar array antenna of the kind referred to whose structure and manufacture are simple, so as to achieve a low overall cost.

BRIEF DESCRIPTION OF THE INVENTION

The present invention provides a coplanar line antenna including multiple planar circuits each comprising a dielectric material supporting a layer of conductive material having apertures and channels formed therein, and adapted to generate or receive electromagnetic radiation having linear or circular polarization, comprising coplanar waveguide lines cooperating in microwave coupling with the apertures, said coplanar waveguide lines comprising a center conductor located within the channels, the channels issuing into the apertures and the center conductors penetrating into and terminating in the apertures to form probes, and a lower ground plane of conductive material parallel to the planar circuit comprising the apertures and coplanar waveguide lines located at a distance of approximately a quarter of the wavelength at which the antenna operates.

In a preferred embodiment of the invention, the array is accommodated in an open housing whose metal base forms a reflecting plate.

According to a preferred feature of the invention, the apertures are excited in two orthogonal directions with a phase difference of 90° so as to obtain circular polarization.

Preferably, the space between the printed circuit board and the reflecting ground plane is filled with a foam of synthetic material.

DESCRIPTION OF THE DRAWINGS

Other features and advantages of the invention will appear from the following description of embodiments thereof, given by way of example with reference to the accompanying drawings, in which:

FIG. 1 is a plan view of part of an array antenna in accordance with an embodiment of the invention, FIG. 2 is a perspective view of the antenna shown in FIG. 1, FIG. 3 is a detail view of part of the antenna of FIG. 1, showing different parameters of a general coplanar waveguide feed line, FIGS. 14 to 16 show different embodiments with cavities behind the radiation elements.

DESCRIPTION OF THE PREFERRED EMBODIMENTS

Figure 4:
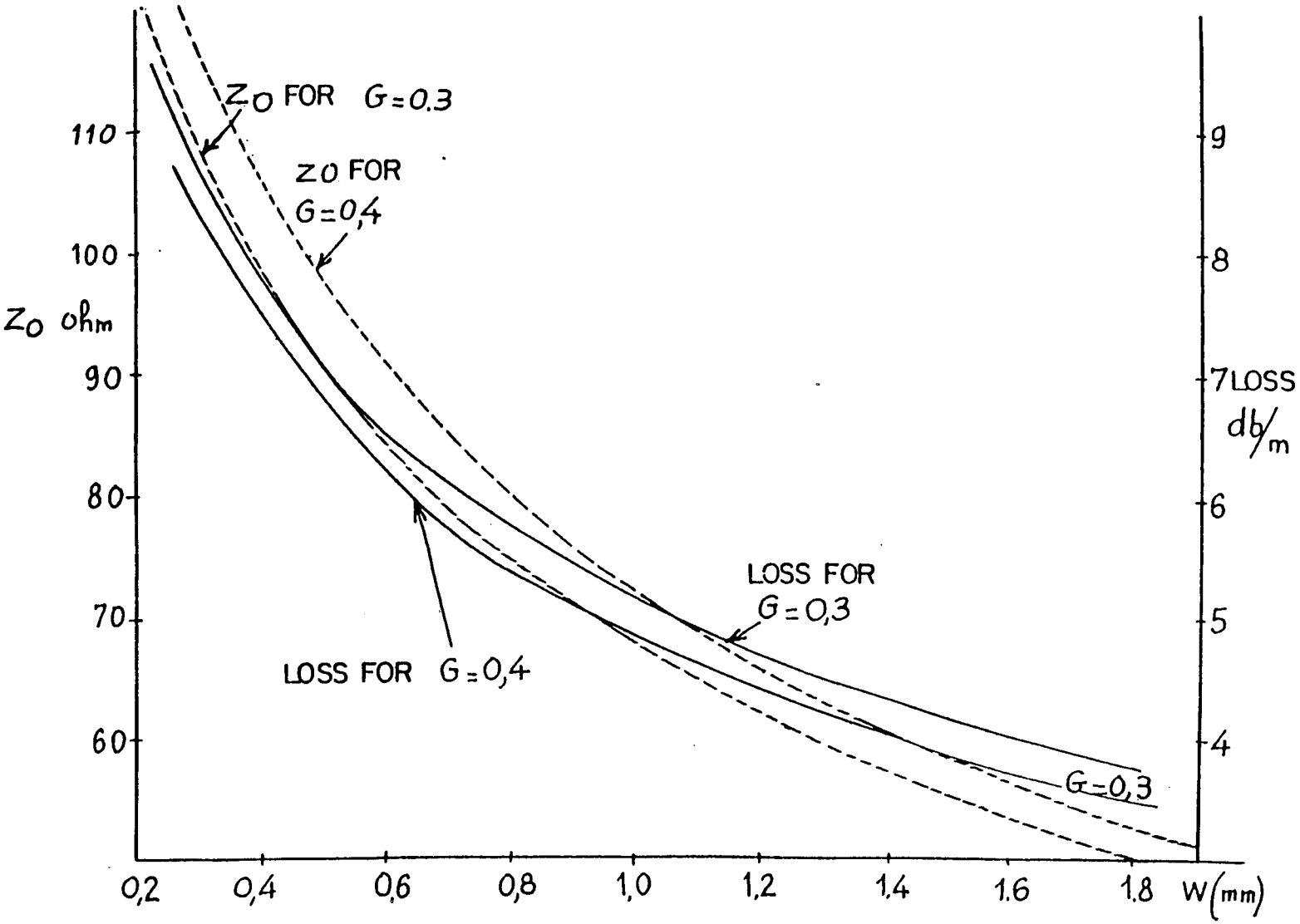
FIG. 4 is a graph of the characteristic impedance and losses as a function of the width of the central conductor of the feed line.

FIGS. 1 and 2 illustrate an embodiment utilizing the principle of the present invention; on a thin dielectric layer 1, single face printed circuit techniques are used to produce an aperture formed in the illustrated example by a circular slot 2 and a feed conductor 3, the ground plane is formed by a metal coating 4 on the dielectric layer 1 and printed circuit techniques are used to produce the slot 2 and feed conductor 3 therein, the conductor 3 with channels 5 formed in the ground plane 4 forming a line of the coplanar waveguide type. Other shapes of apertures can be used, such as square, rectangular, elliptical, etc. The excitation probe 6 can go through the center of the aperture, or be eccentric. The complete element therefore forms a single face printed circuit board and all the parts, namely the ground plane 4, the slot 2 and the coaxial conductor 3 are therefore coplanar. The conductor 3 is produced within channels 5 by removing metal from the layer 4 so as to form a coplanar waveguide comprising a termination 6 projecting within the slot 2 and coplanar therewith, termination 6 forming an excitation probe.

The complete element is disposed at a distance of approximately one quarter wavelength from a reflecting ground plane 7 parallel to the printed circuit 8, in order to produce uni-directional radiation.

Theoretical studies have been made of such a slot antenna excited by a coplanar waveguide, and FIG. 4 illustrates the impedance and losses of this structure as a function of certain parameters which are indicated in FIG. 3; in FIG. 3, W is the width of the central conductor of the coplanar waveguide, G is the gap between the central conductor 3 and the ground plane, and the gap between the printed circuit and a possible external ground plane is indicated by $H_L$. Lastly, H indicates the thickness of the dielectric layer of the printed circuit and $H_u$ indicates the gap between the printed circuit and another possible ground plane, for example the cover of a housing, disposed on the opposite side.

The graph of FIG. 4 shows the impedance in ohms and the losses in dB/m as a function of the width W of the central conductor 3, expressed in mm.

The calculations were made using a standard program of computer aided design ("Super Compact") at 12.1 GHz and the various parameters in this example had the following values:

$H=0.025$ mm $H_L=5$ mm.

$H_u$ is infinite (there is no upper external ground plane).

The width A is equal to 20 mm.

The dielectric constant of the substrate is equal to 2.2.

The loss tangent of the dielectric is equal to 0.02.

The graphs of impedance and losses have been traced for two values of the gap $G=0.3$ mm and 0.4 mm.

Figure 5:
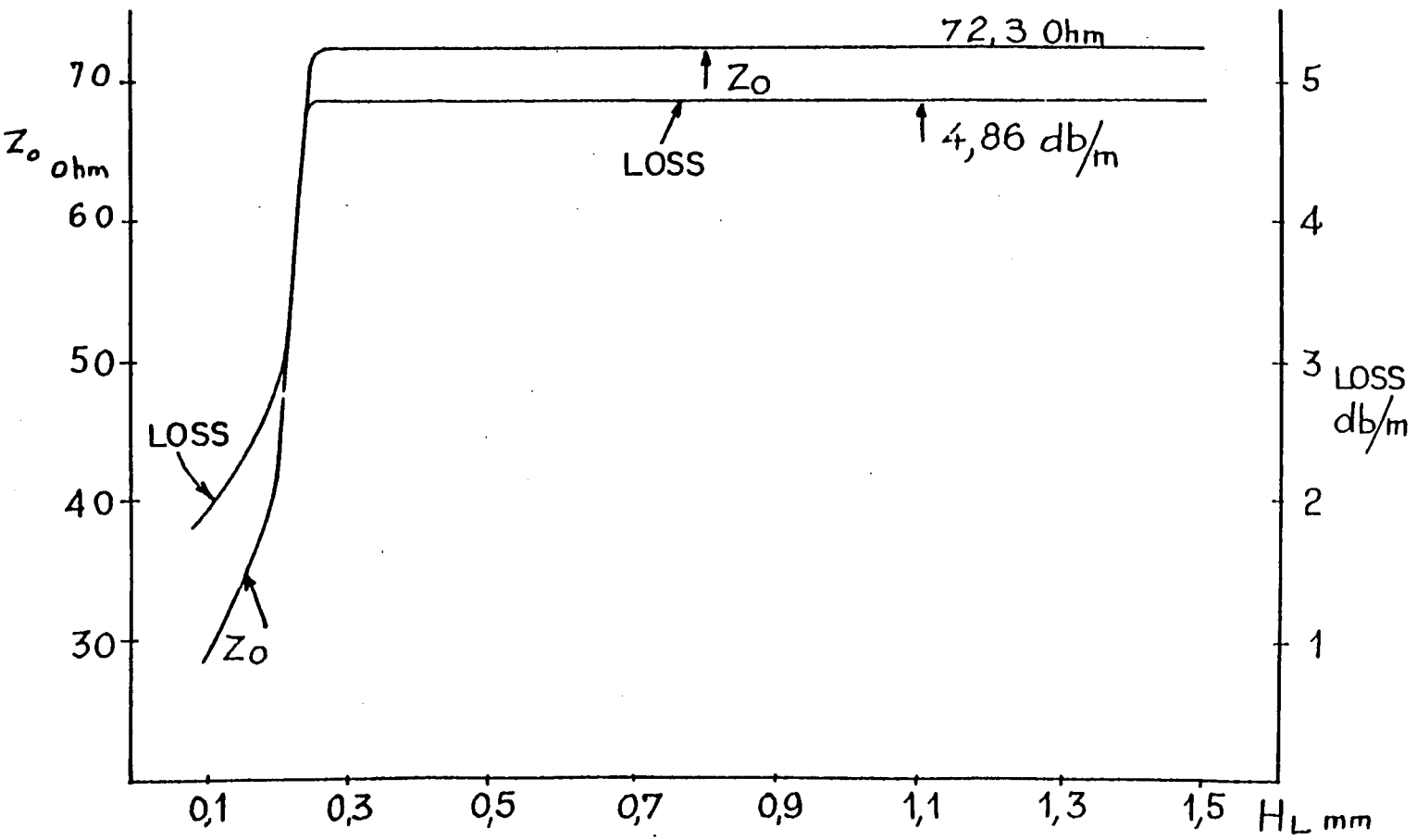
FIG. 5 is a graph of the characteristic impedance and losses as a function of the distance $H_L$ from an external ground plane.

FIG. 5 shows the values of impedance and losses with the same units as FIG. 4 as a function of the gap $H_L$ expressed in mm, with the same values for the other parameters, the width W of the conductor being 1 mm and the gap G 0.4 mm. It will be seen that the gap $H_L$ no longer influences the impedance nor the losses once this gap is greater than about 0.3 mm in the case calaculated here. This minimum gap obviously depends on the other dimensions of the coplanar line and on the operating frequency. For 12 GHz, and taking account of calculation errors, above a gap of 1 to 2 mm, the influence of a metal plate becomes negligible. This has to be checked experimentally in each case; it is important to note that the value of losses is small and this is confirmed for other pairs of values of the dimensions G and W of the coplanar waveguide.

Figure 6B:
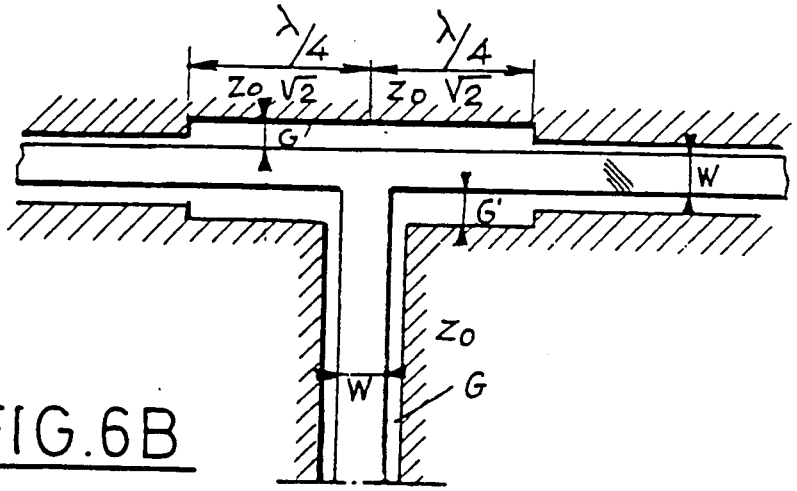
FIGS. 6A to 6C illustrate three embodiments of a T power splitter.
Figure 6A:
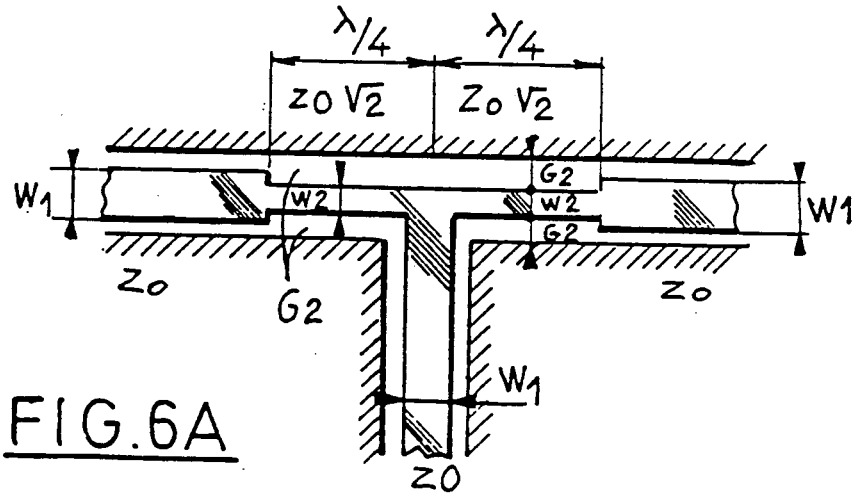
Figure 6C:
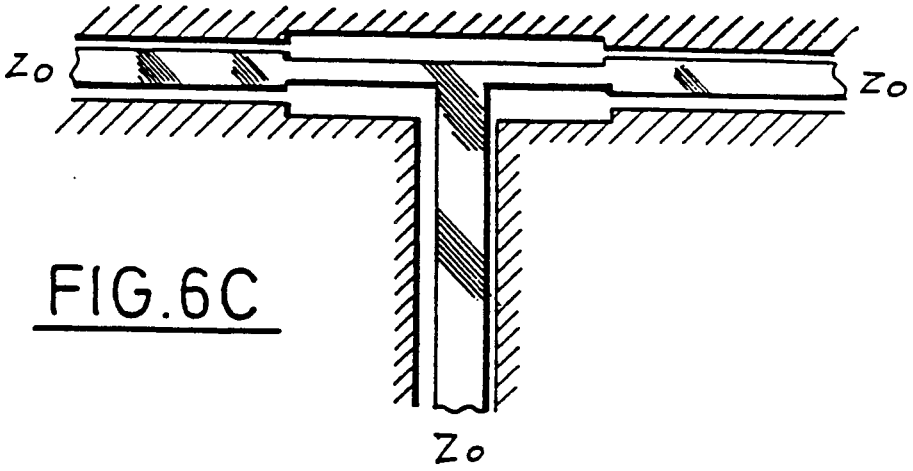

FIGS. 6A to 6C are plan views of three embodiments of a T power splitter. In the first embodiment of FIG. 6A, the impedance changes required for matching are obtained by reducing the width of the central conductor from W1 to W2 over a length corresponding to twice a quarter wavelength; in the embodiment of FIG. 6B this impedance change is obtained by widening the channels that is to say by increasing the gaps from G to G'; lastly, in the embodiment of FIG. 6C, both the features of FIGS. 6A and 6B are combined.

Figure 7B:
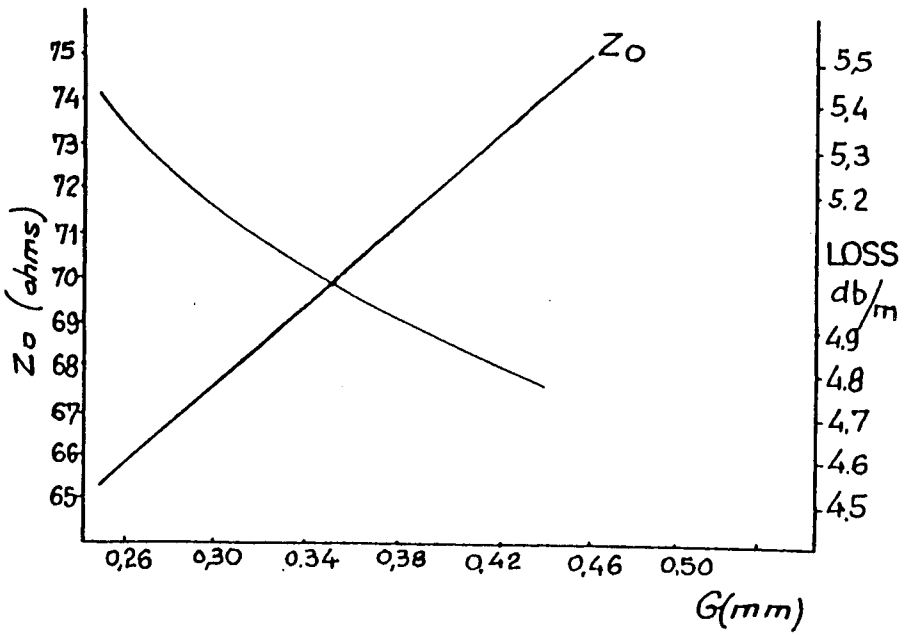
FIG. 7B is a graph of losses and the characteristic impedance as a function of the distance G.
Figure 7A:
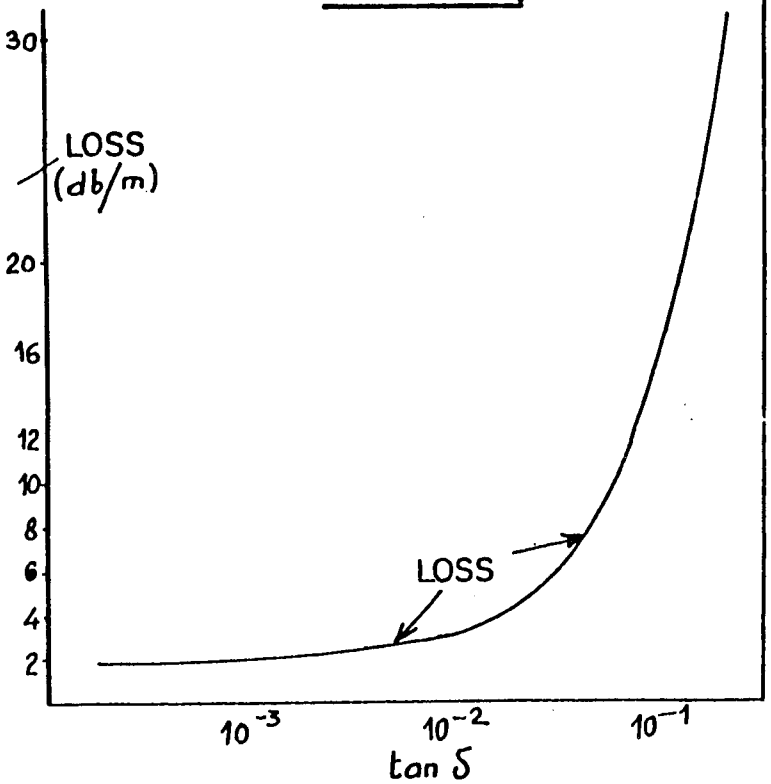
FIG. 7A is a graph of losses as a function of the loss tangent.

FIG. 7A shows the variation of the losses in dB/m as a function of the tangent of the loss angle for values of the parameters equal to those indicated above, the width W being 1.2 mm and the gap G 0.4 mm. It will be seen that, even for a frequency of 12 GHz, a thin dielectric layer of poor loss performance (loss tangent 0.02) gives an acceptable level of losses.

FIG. 7B shows the variation of impedance and losses as a function of the gap G expressed in mm and it will be seen that this gap has relatively little influence on the impedance.

It follows from the above that large tolerances can be accepted for the dimensions of the coplanar waveguide.

As for the dielectric material, it is possible to use materials available under the trade name Mylar or Kapton; for a dielectric thickness of 0.025 mm, a loss tangent of 0.002 and a dielectric constant of 2.2, the waveguide losses are about 4 dB/m. It is also possible to use cross-linked polystyrene reinforced with glass fiber; for a thickness of 0.25 mm, and loss angle tangent of 0.001 and a dielectric constant of 2.6, the losses are 3.55 dB/m.

The above selections are not limitative.

It is useful to be able to use an external reflecting plane for the radiation slot, as its distance from the printed circuit can be optimized independently of the dimensions of the coplanar feed line provided that this distance of about $\lambda/4$ is greater than 1 mm, as indicated by the graphs of FIG. 5 (which is the case at 12 GHz, where $\lambda/4$ is equal to 6.25 mm). If for some selected geometry this condition is not met then the line computations have to take into account the presence of the ground plane, without limiting the applications of the invention.

The central conductor of the coplanar waveguide excites the radiation slot as a probe, in linear polarization. The matching of the radiator to a given waveguide impedance is obtained by optimum selection of the geometry of the element, mainly the length of the probe formed by the termination 6, the width and shape of this termination, the diameter of the slot and the gap from the reflecting ground plane.

The radiation element produced is therefore a slot over a reflecting plane with an optimum gap; this slot is excited by the central conductor of a "coaxial" line; the performance of such an antenna is known to be very good.

Figure 8:
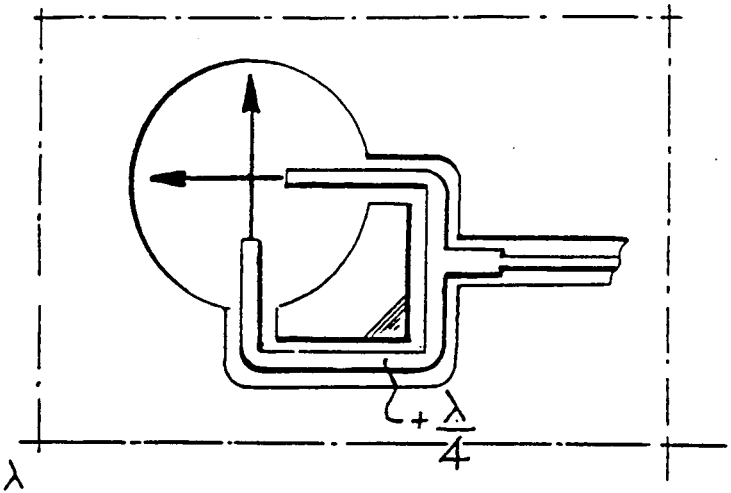
FIG. 8 illustrates an embodiment which produces circular polarization.

The slots can also be excited in circular polarization by the use of two perpendicular probes excited with a 90° phase difference. This can be achieved by connecting the excitation lines to a 3 dB hybrid splitter. In another method shown in FIG. 8, a T splitter is used and one of its feed branches is a quarter wavelength longer than the other so as to produce the 90° phase shift.

The axial ratio and symmetry of such a single radiator element with T-excitation as described above may not be very good at all frequencies within the band.

Figure 9:
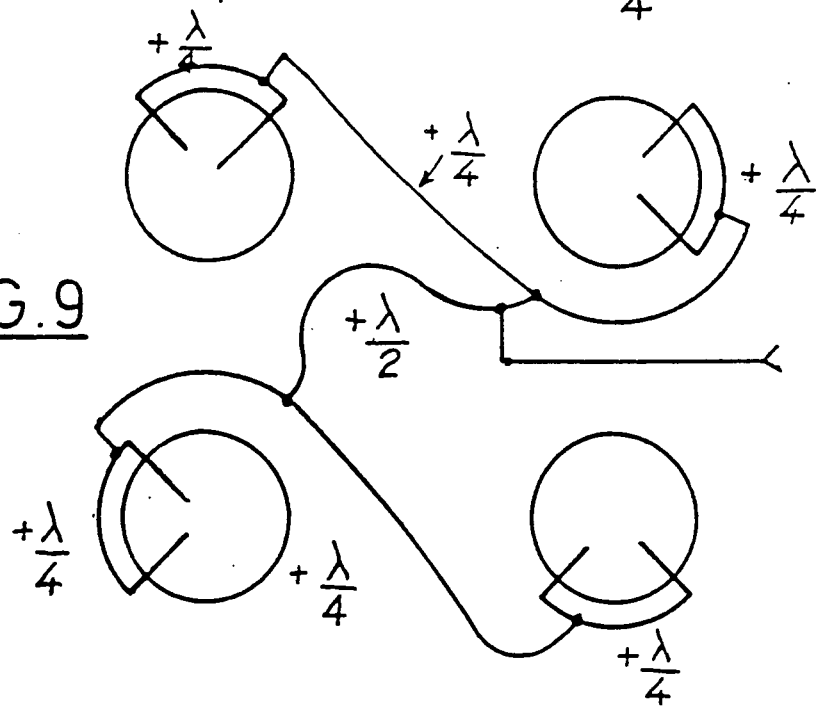
FIGS. 9 to 11 show different circular polarization embodiments of an antenna comprising four radiation elements.
Figure 10:
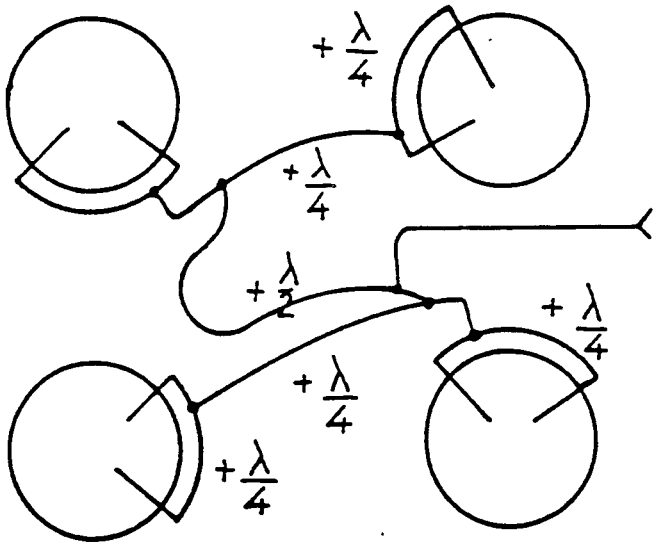
Figure 11:
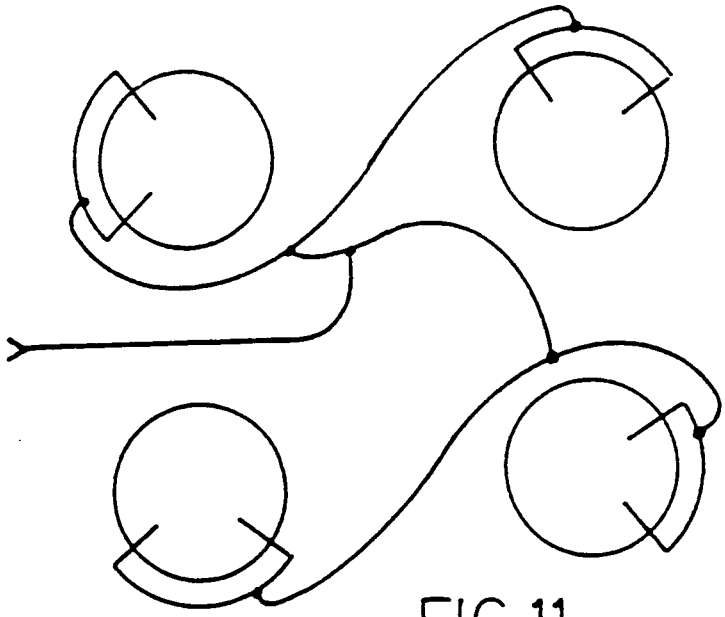

To improve the axial ratio of the pattern, sequential rotation methods can be used as shown in FIGS. 9 to 11.

In FIG. 9, a four radiator sub-array is excited in a right-hand circular polarization mode; each radiator is excited by two perpendicular probes at 90° phase difference. The different radiators are rotated by 90° relative to each other. This rotation is equivalent to a phase shift of 90° of the circularly polarized signals and is compensated by corresponding lengths in the feed lines; the radiators are thus excited with respective phases of 0, 90, 180 and 270 degrees.

FIG. 10 corresponds to FIG. 9, except that the sub-array is arranged to give left-hand circular polarization.

It is interesting to note that the symmetrical arrangement about a plane to FIG. 9, corresponding to FIG. 11 gives the opposite sense of circular polarization (left-hand).

Figure 12:
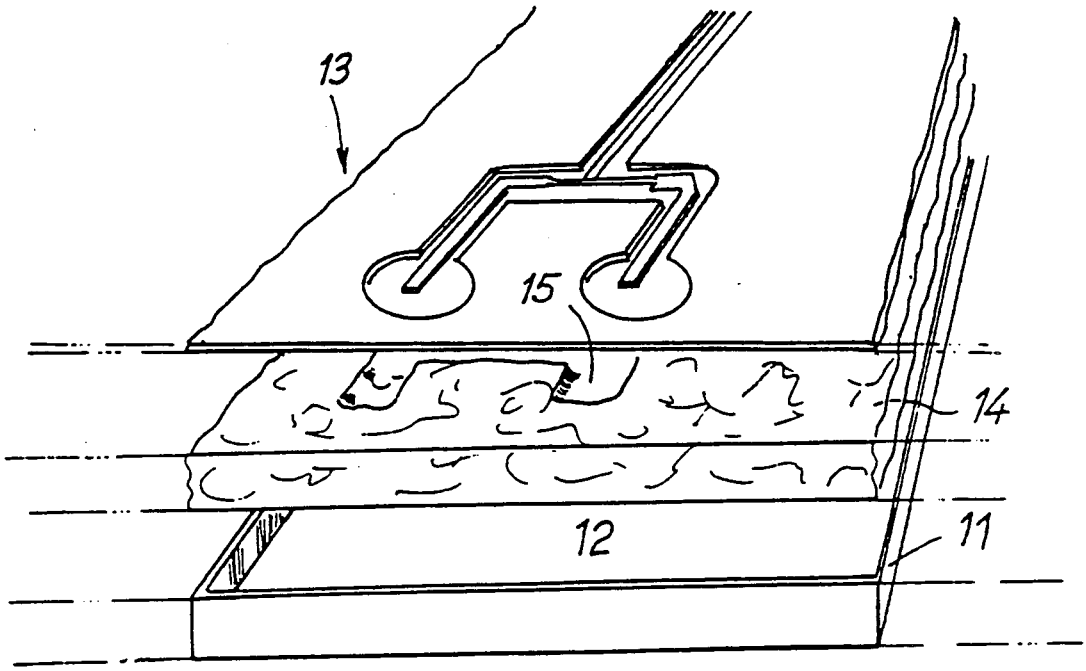
FIG. 12 shows an embodiment incorporating a foam spacer plate, for a four element antenna in linear polarization.

FIG. 12 shows a practical embodiment of an array antenna in accordance with the invention. The reflecting ground plane in this embodiment comprises an open metal housing 11 whose base 12 forms the ground plane itself. The dielectric substrate of the printed circuit 13 is one of the materials referred to above, for example, in particular those available under the trade names of Mylar or Kapton; its thickness is 0.025 mm. The gap between the printed circuit 13 and the reflecting ground plane 12 is filled with low density dielectric material, for example in the form of foam. This dielectric material may be formed of expanded polystyrene or similar material.

As shown in FIG. 12, the upper face of the foam layer 14 may comprise wide grooves 15 juxtaposed with the feed conductors, such grooves not being indispensable, however. The depth of the grooves is greater than about 1 mm so as to minimize any interference with the foam and additional dielectric losses. The shape of the grooves is not critical and the edges do not need to follow the feed lines precisely; it is sufficient to have a width greater than the width of the feed lines. The gap between the slots and the ground plane is not critical either and so neither is the thickness of the foam layer 14. Moreover, as the foam is not part of the transmission lines it does not contribute to the losses and a low cost material such as expanded polystyrene can be used.

Figure 12A:
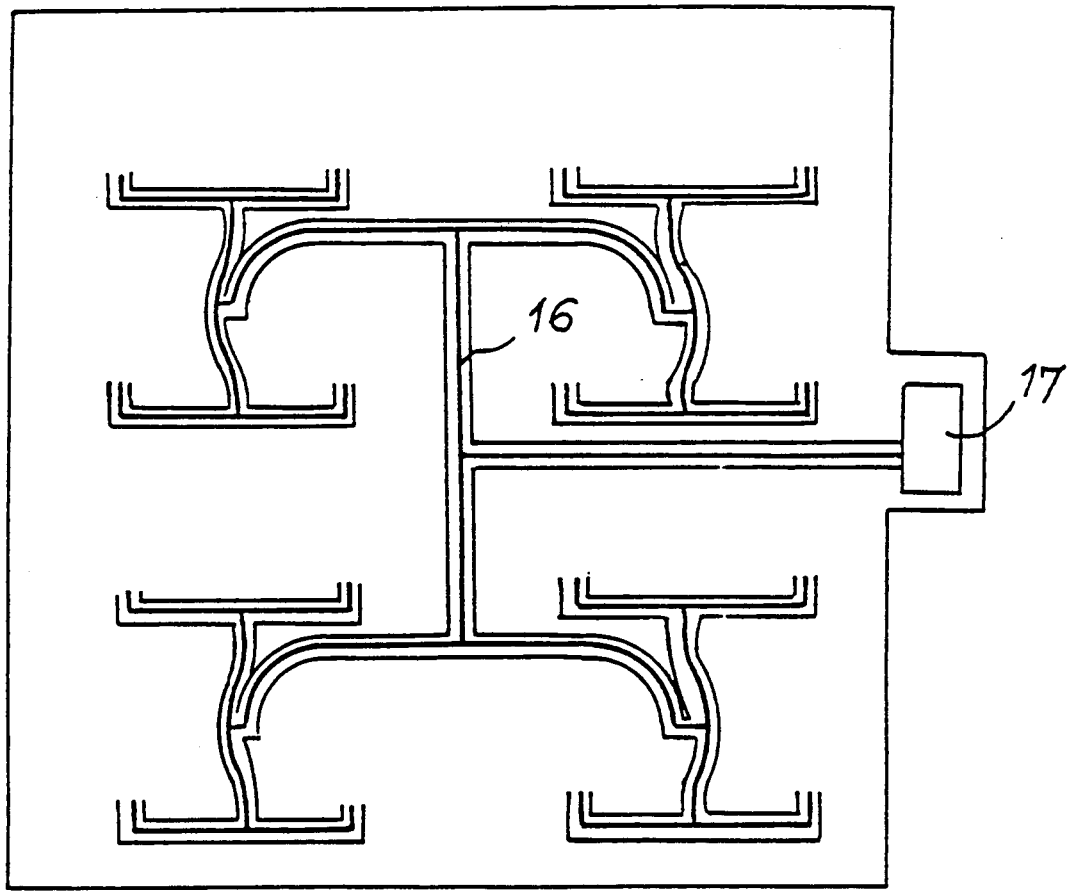
FIG. 12A is a top view of the embodiment of FIG. 12.

FIG. 12A relates to an array of linear polarization slots, but it will be appreciated that the same production technique can be applied to arrays of circular polarization slots.

FIG. 12A shows a top view of a sixteen radiators array antenna having the structure disclosed in connection with FIG. 12. On this figure, all the feed elements are coplanar waveguides but they are represented by solid lines and the radiators are not shown for clarity purpose. All the feed lines 16 are fed by a waveguide output 17.

Figure 13:
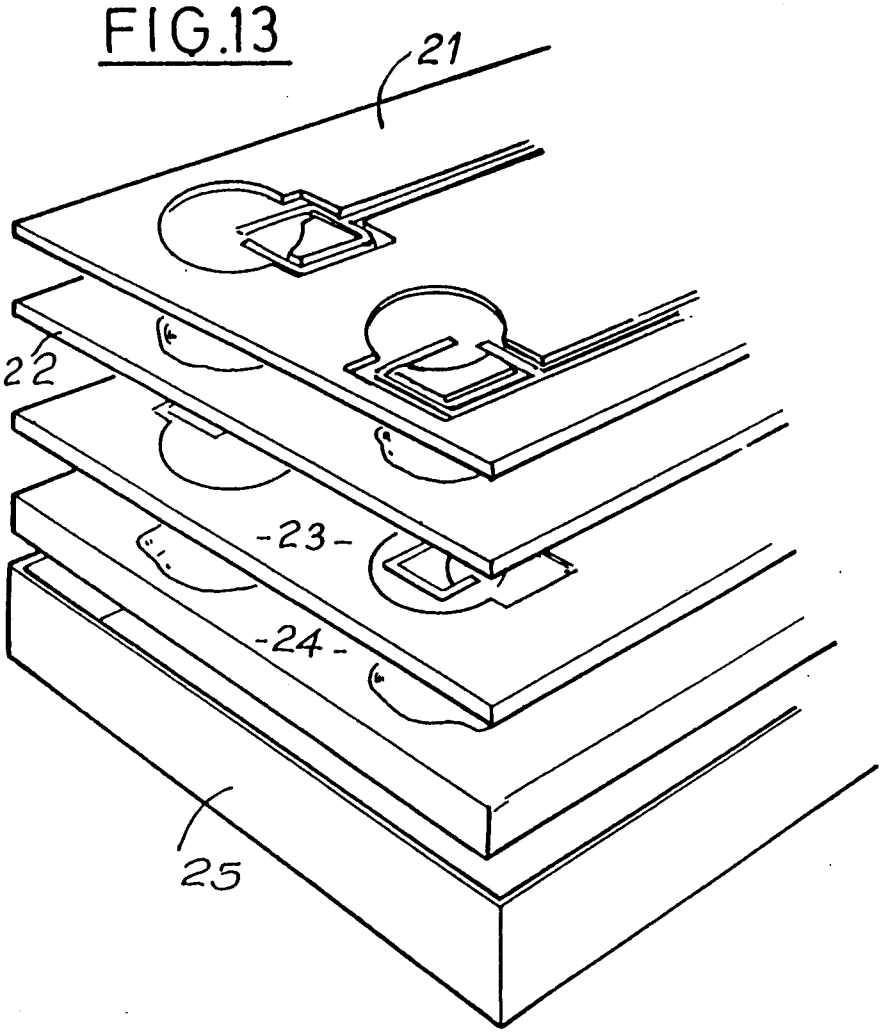
FIG. 13 shows a practical embodiment corresponding to an antenna in accordance with the invention having two independent circular polarizations.

FIG. 13 shows an embodiment of a slot array antenna with double circular polarization; it comprises a first printed circuit 21 whose pattern corresponds to that shown in FIG. 9 and which therefore provides right-hand circular polarization, a foam spacer layer 22 whose thickness is 1 to 2 mm, for example and which presents grooves comparable to those of FIG. 12 on both its faces, a second printed circuit 23 which corresponds to the pattern of FIG. 10 and which provides left-hand circular polarization, a foam layer 24 corresponding to the foam layer 14 of FIG. 12 and a housing 25 accommodating all the other components. An array antenna having double slots and two independent circular polarizations is thus obtained.

Two linear polarizations can also be produced with such a configuration.

Figure 14:
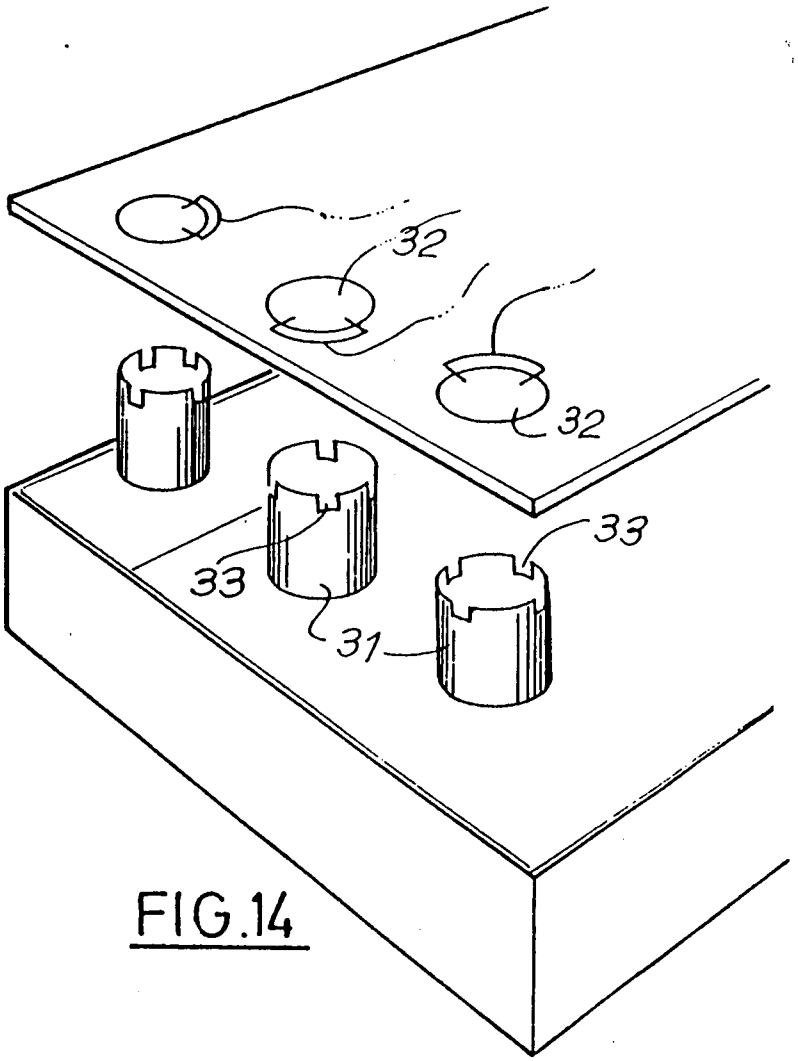

FIGS. 14 to 16 illustrate three embodiments in which cavities are formed behind the radiation elements as described in French Patents No. 87 00 181 of Jan. 19, 1987 and No. 87 15 742 of Nov. 13, 1987. The diameter of the slots for operation at about 12 GHz may be approximately 16 mm. The diameter of the cavities behind the slots may be in the range of 16 to 23 mm. In the embodiments illustrated in FIGS. 14 to 16, each radiation element is formed by one (or two) slot(s) for one (or two) polarization(s) and by a cavity behind plus, if desired, an open cavity in front. In the embodiment of FIG. 14 cylindrical parts 31 are formed in the foam, which form cavities behind the slots 32 and which are juxtaposed to the slots. The upper edges of these metallic cylindrical parts present indentations 33 which are juxtaposed with the coplanar feed lines: the depth of these indentations is at least 1 to 2 mm, to avoid interference with the feed lines, as explained above (there are preferably four indentations per cavity for reasons of symmetry and simplicity of manufacture).

In the embodiment of FIG. 15, cylindrical cavities 42 are inserted into the foam layer 41, the cavities stopping short of contact with the printed circuit 43, the spacing of the top of the cavities 42 from the printed circuit being at least 1 to 2 mm to avoid interference with the feed lines. It will be appreciated that, for a frequency of 12 GHz, the spacing is advantageously 1 to 2 mm.

In the embodiment of FIG. 16, criss-cross partitions 52 are disposed in the housing 51 to form a grid; these partitions are formed of thin metal sheet whose upper edge is always spaced from the printed circuit by at least 1 to 2 mm by means of a layer of dielectric foam to avoid interference with the printed circuit.

In order to improve the performance of the antenna, a set of open cavities may be used in front of the slots (as described in French Patents No. 87 00 181 of Jan. 9,1987 and No. 87 15 742 of Nov. 13, 1987).

Figure 17:
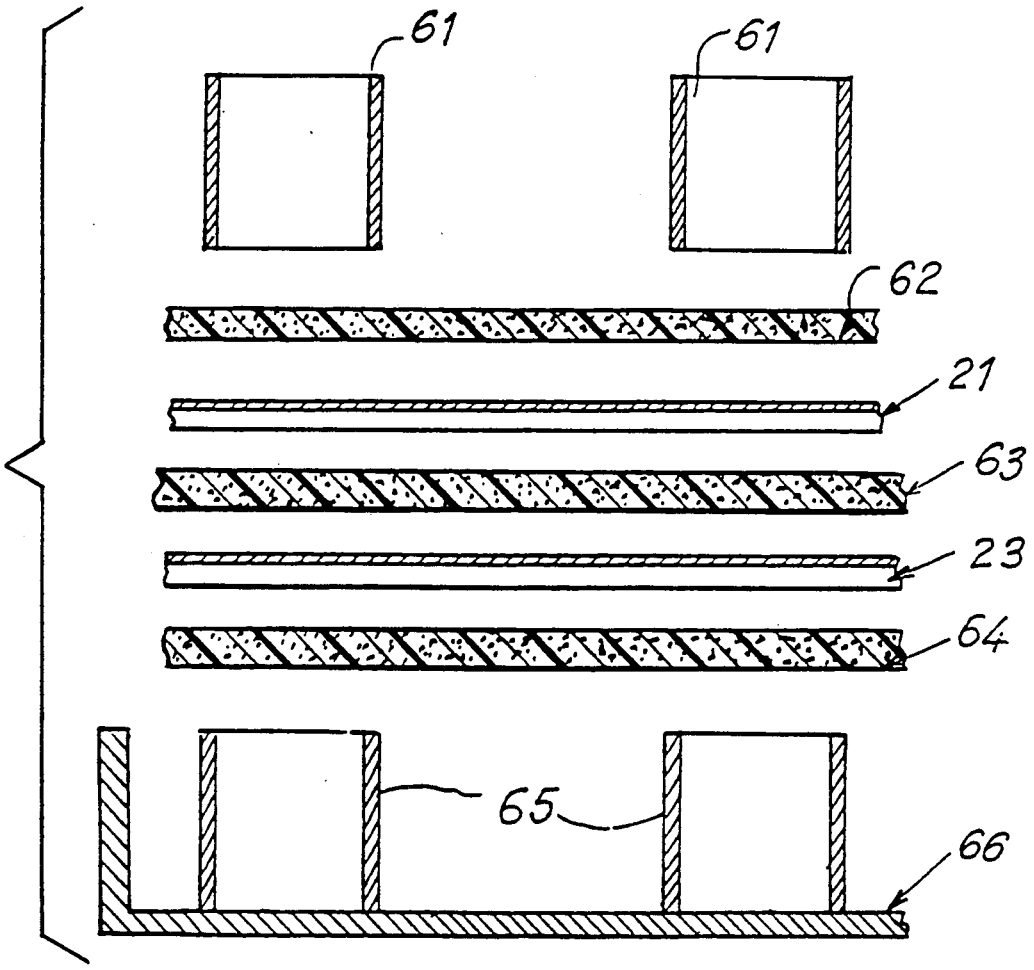
FIGS. 17 and 18 show an embodiment having closed rear cavities and open front cavities for the radiation elements and comprising two printed circuits for generating two orthogonal linear or circular polarizations.
Figure 18:
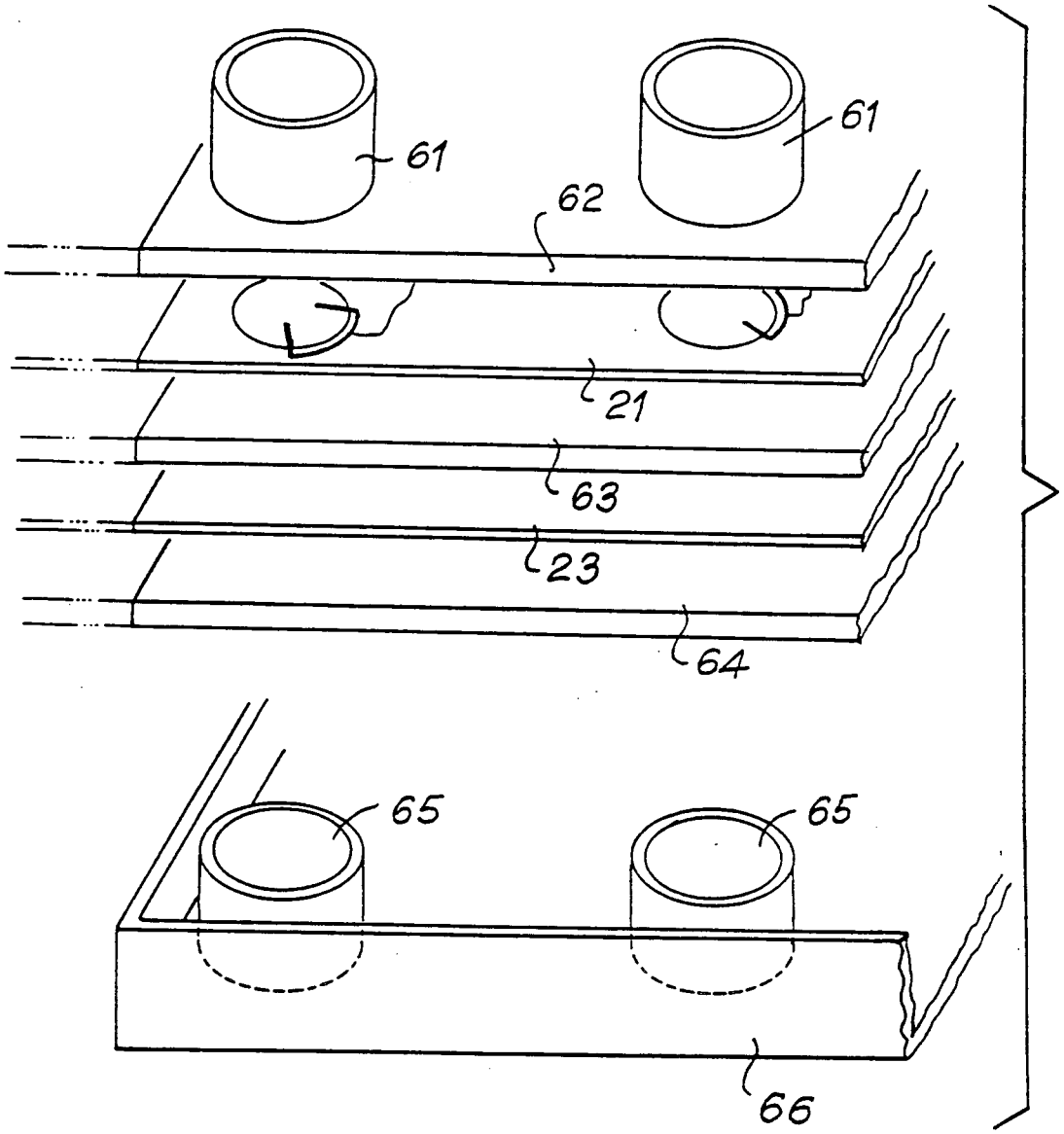

In the embodiment of FIGS. 17 and 18, the antenna structure shown has two orthogonal circular or linear polarizations with open front cavities and closed rear cavities. The open front cavities 61 are spaced from a first printed circuit 21 by a first layer of foam 62 of 1 to 2 mm thickness, the first printed circuit 21 being separated from a second printed circuit 23 by a second layer of foam 63 of thickness 1 to 2 mm. The second printed circuit 23 is separated from the rear closed cavities 65 by the foam layer 64. The cavities 65 are closed either by the face of a metal housing 66 or by their own bases. The rear cavities 65 may be filled with foam or may be empty. For a single polarized antenna, one of the circuits 21 or 23 is removed as well as the foam layer 63.

Figure 19:
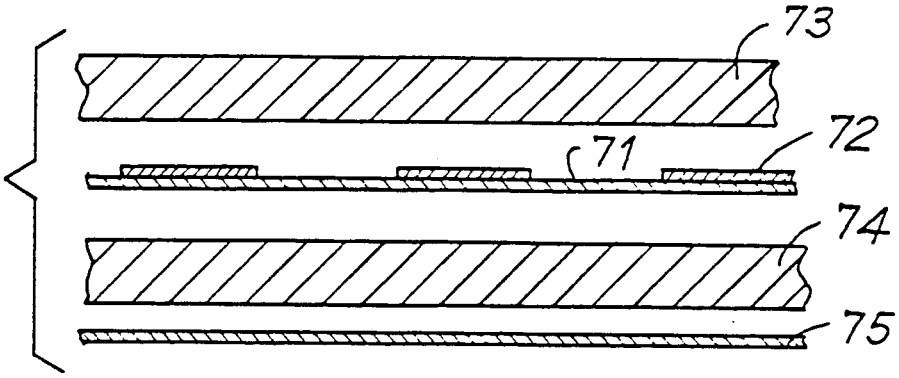
FIGS. 19 to 23 show alternative embodiments.

FIGS. 19 to 23 are exploded views of alternative embodiments. In the embodiment of FIG. 19, a thin (e.g. some microns) printed dielectric layer 71 with printed conductors constituting the radiators and feed lines is sandwiched between two thicker foam layers 74 and 74. The lower foam layer 74 has a thickness of about a quarter of a wavelength. The two thicker dielectric foam layers can be identical.

All these layers together with a ground plane conductor layer 75 are glued together.

The upper thicker dielectric layer 73 can be used as a radome.

Figure 20:
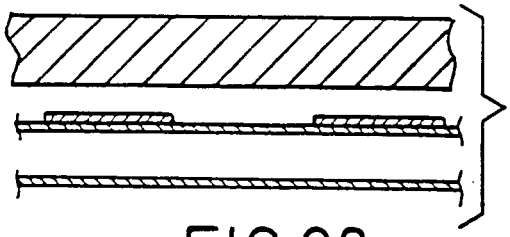

FIG. 20 shows an embodiment of FIG. 19 but without lower thick dielectric layer. In this case, the upper layer 73 can also be used a radome.

Figure 21:
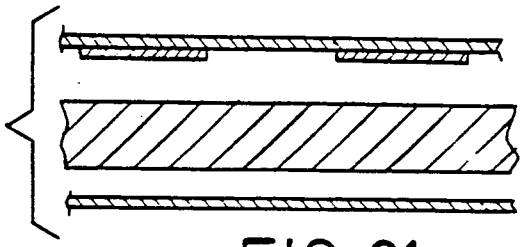

In the alternative embodiments of FIG. 21, there is only the lower dielectric layer that constitutes a spacer between the printed layer 71 and the ground plane 75.

In this case, the printed conductors 72 are facing this dielectric layer.

Figure 22:
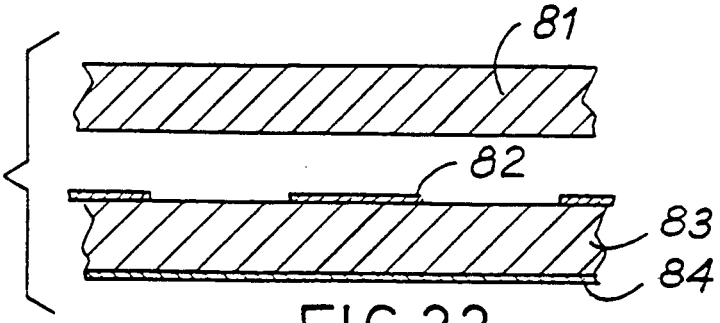
Figure 23:
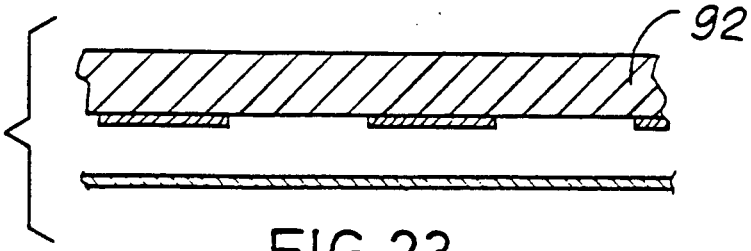

The embodiments of FIGS. 22 and 23 correspond to the embodiments of FIGS. 19 to 21 with the difference that the conductors are directly printed on one of the thick dielectric layers. In the embodiment of FIG. 22, the upper layer 81 can be used as a radome and the conductors 82 are directly printed on the lower thick dielectric layer 83, the ground plane conductors layer 84 can also be printed on the dielectric spacer layer 83 having a thickness of about a quarter of the wavelength.

In the embodiment of FIG. 23, the printed conductors 91 are directly printed on the upper thick dielectric layer 92 that constitutes an inverted radome.

FIGS. 24 to 27 show other embodiments where a circular polarization (CP) is produced by using only one probe.

The circular polarization production by one only probe excitation in printed type arrays is based on the generation of two linear perpendicular modes in the radiator with a 90° phase difference.

This can be obtained by creating a "perturbation" in the 45° plane with respect to a unique probe such as to "load" with a capacitance or an inductance one of the two perpendicular modes in which the linear polarization mode excited by the probe can be analyzed.

Figure 24:
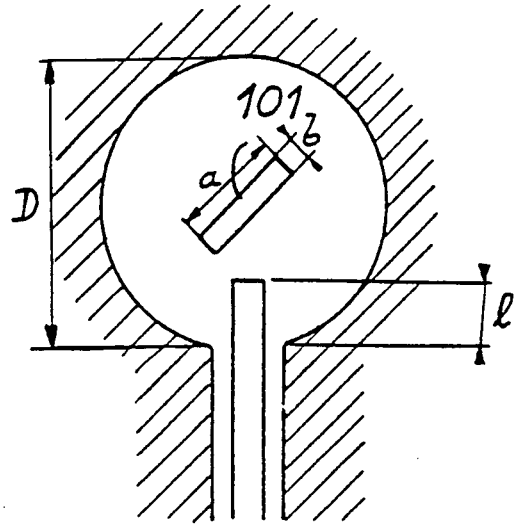
FIGS. 24 to 27 show alternative embodiments producing circular polarization by using only one probe.

FIG. 24 shows such a CP radiator comprising a printed bar 101 that is inclined at 45° with respect to the excitation probe.

As an example, around 12 GHz in X-band, for a slot of about 15.5 mm diameter and an excitation probe of about 4.8 mm the 45° bar dimensions are about 5 to 6 mm for the bar length, a, and about 2 to 3 mm for the bar width, b, for CP production.

Figure 25:
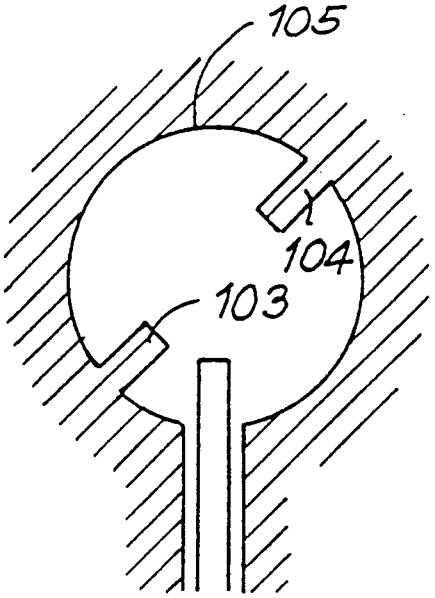

FIG. 25 shows an embodiment comprising two printed bars 103 and 104 that are diametrically opposed in the slot 105.

Figure 26:
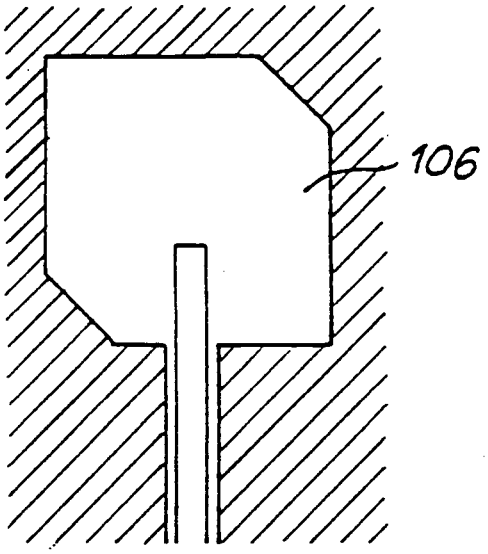

In the embodiment of FIG. 26, the CP is obtained with an asymetrically cut radiator aperture 106.

Figure 27:
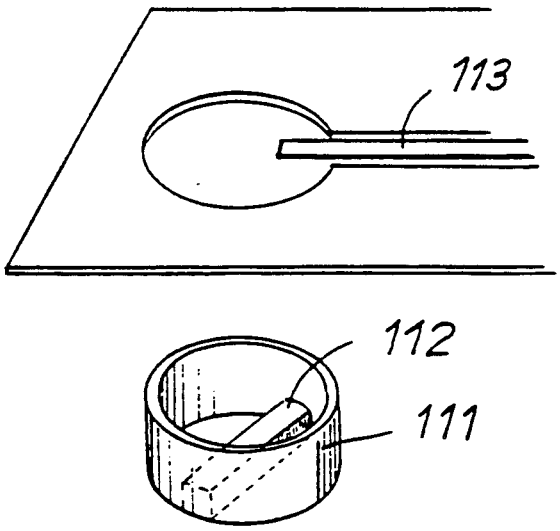

FIG. 27 shows an embodiment with a CP circular polarization obtained with only one probe in the case of an array comprising back cavities 111; in that case, the CP is produced with a bar 112 formed at 45° with respect to the printed probe 113; this bar constitutes a "septum" formed in the lower part of the back cavity 111. The thickness of this bar is preferably some millimeters for X-band.

Various asymetrical back (or front) cavities are also possible methods for CP production e.g. rectangular cavities with cut corners, etc.

For all the above options sequential rotation can be applied in order to improve the axial ratio.

The above perturbation methods can be also applied for improving the decoupling of two perpendicular linear polarizations excited in the same radiator by two perpendicular probes.

For dual linear polarization operation the "typical" about 20 dB decoupling of the probes could be reduced to about 30 dB in about 10% bandwidth by using the perturbations consisting in a printed bar or a septum.

Figure 28:
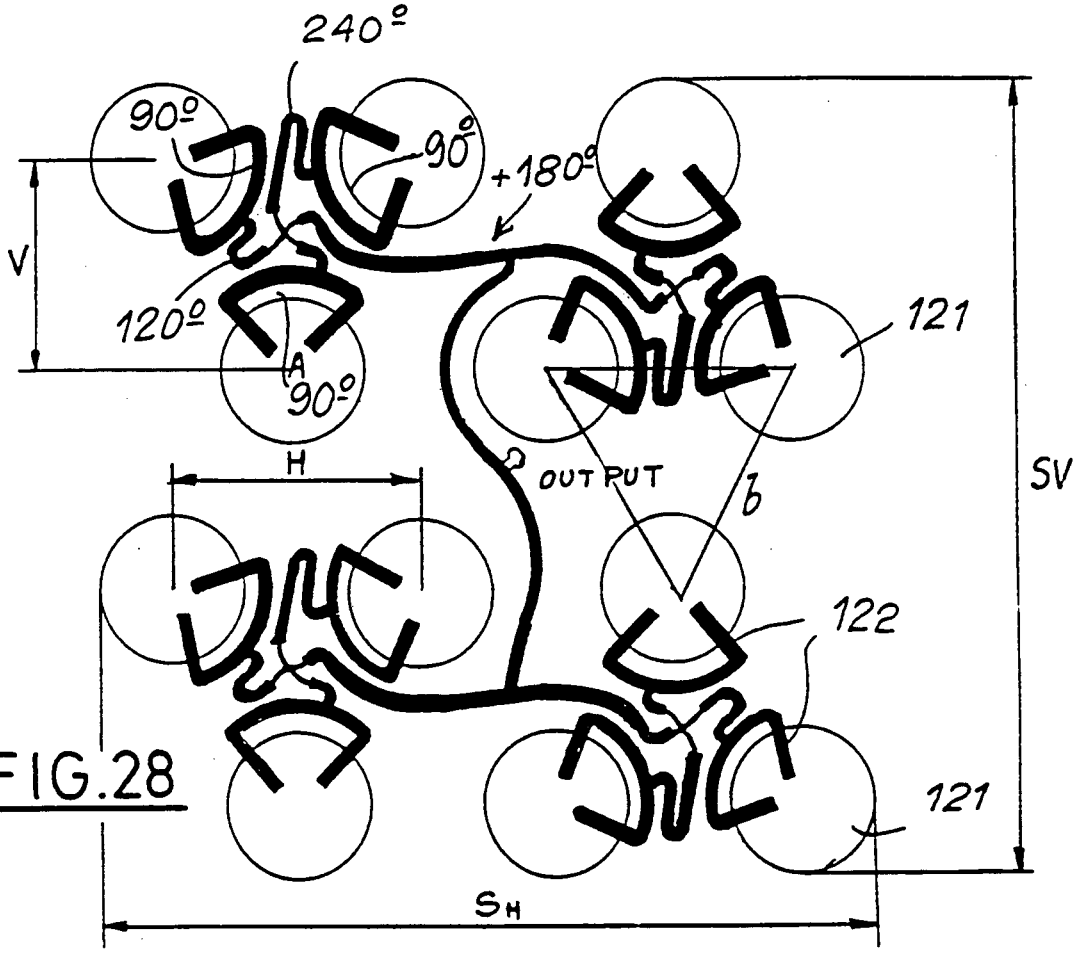
FIGS. 28 to 29 show alternative embodiments with triangular lattice feed configuration.
Figure 29:
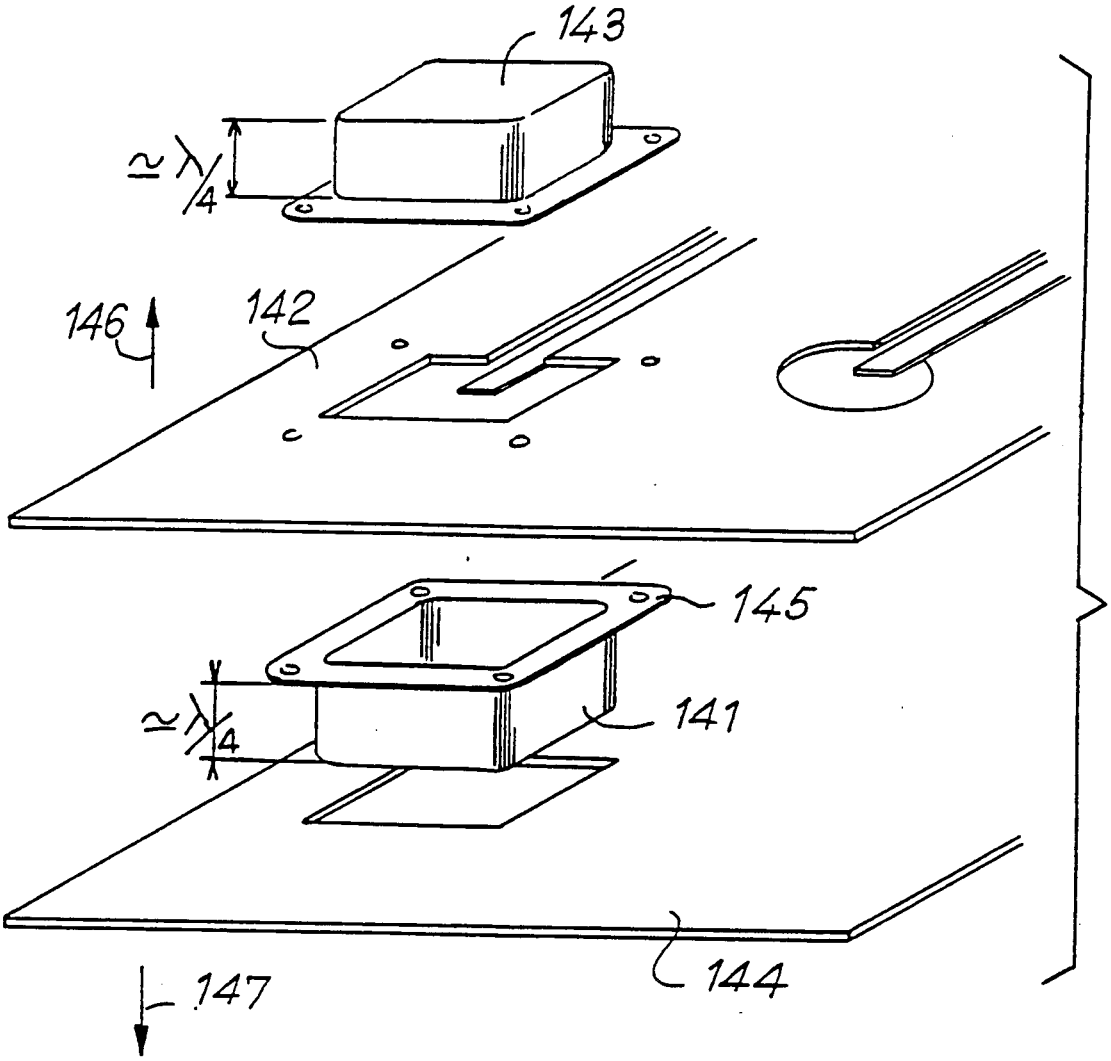

FIGS. 28 to 29 show triangular lattice configurations with equal power dividers feed network.

The corporate feeds are known to be large bandwidth, low tolerance circuits.

They are easily applicable to rectangular lattice arrays having a number of radiators equal to a power of 2 (2,4,8,16, etc.).

For arrays having a number of radiators not being a power of two, unequal power dividers would be required.

A "subarraying" is described below using a corporate feed with equal power divisions for arrays with $m \times 2^{**}n$ radiators even in a triangular lattice.

As an example an $m=3$ subarraying is described below.

The principle is shown in FIG. 28.

Subarrays of three radiators ($m=3$) are fed using sequential rotation for improved CP production (arrangements without sequential rotation are obviously also possible).

A thick line representing, for simplicity, the feed line is shown here feeding the radiating slots.

In this figure, each radiator 121 is excited by two perpendicular probes 122 fed with 90° phase shift and equal power for CP production (equal or unequal power dividers having one branch quarter wavelength longer can be used for this).

Each radiator is rotated 120° with respect to the others and is fed with corresponding (120° or 240° ) phase shift produced by appropriate line lengths as shown in FIG. 28.

CP radiators with one only probe excitation for CP operation or LP radiators for LP or CP operation can also be used. This gives advantageously more space for the feed lines between the radiators.

A one to three equal power divider is used in this feeding circuit.

The various required line impedances can be selected by e.g. varying the widths of the center conductors or the other methods illustrated by FIG. 6.

An adjacent, inverted subarray can be fed in the same way and their feeding lines connected with a 180° phase difference to an equal power divider in order to obtain the same CP phase.

An identical six elements arrangement can be connected to the previous one through an equal power divider.

This creates a 12 elements subarray with a size of about 2 to 2.5 wavelengths, well suited for earth coverage arrays placed in geostationary orbit.

The above subarraying is advantageous as 12 radiators, of about 0.6 to 0.9 wavelength size each, in triangular lattice can be closely packed in the 2.0 to 2.5 wavelengths space usually required for earth coverage subarrays, instead of the 7 or 9 used in prior configurations.

This arrangement can be of course applied also with other types of radiators e.g. with patches.

The above subarray can be combined through a typical corporate feed in order to make larger arrays, e.g. a 192 elements array.

The impedance of the lines carrying the signal from the subarrays to the output can be low because there is sufficient space between the slots for this (e.g. less than 50 Ohms lines are possible) having the advantage of reducing the losses of the lines.

A waveguide output 141 can be arranged in the array either in its center by removing e.g. one radiator or at other locations in the array, e.g. at its side as is the case in FIG. 12A. FIG. 29 illustrates the principle of such a waveguide output. In this figure, 142 designates the printed board with the radiators' feed lines and the waveguide output. The "cup" 143 having a depth of about a quarter of the wavelength is represented on the printed board 142. The ground plane 144 is disposed parallel to the printed board 142 at a distance approximatively equal to a quarter of the wavelength. The waveguide output 145 can be fixed to the ground plane 144 and/or to the printed board 142. The arrow 146 shows the direction of the radiation and the arrow 147 shows the direction of the output.

Obviously, the coaxial (or other) to coplanar waveguide transitions, known to persons skilled in the art, can be advantageously used.

It will be seen that these embodiments of the invention offer an antenna of simple structure, easy to manufacture; accordingly, its cost is substantially less than prior art printed planar antennas. These antennas are therefore especially suitable for consumer market applications such as direct reception of television signals broadcast by satellite.

I claim:

1. A planar array antenna adapted to generate or receive microwave frequency, electromagnetic radiation, said antenna comprising:

a sheet of dielectric material;

a layer of conductive material formed on and supported by said sheet of dielectric material;

a lower ground plane member galvanically isolated from said layer of conductive material, said lower ground plane member being located parallel to said layer of conductive material and spaced from said layer at a distance of approximately a quarter of the wave length of the microwave frequency, electromagnetic radiation at which the antenna operates;

a plurality of apertures formed in said layer of conductive material; and coplanar waveguide line means electromagnetically coupled to said apertures at the microwave operating frequency, said coplanar waveguide line means comprising at least one channel communicating with each of said apertures, said channels being formed in said layer of conductive material, and a strip-like center conductor formed in said layer of conductive material and located within each of said channels and extending therealong, said layer of conductive material, channels and center conductors lying in a common plane, said center conductors extending into said apertures and terminating therein at free terminations so that the ends of said conductors in the apertures form excitation probes, the width of said excitation probes taken in a direction normal to the direction of extension of said center conductors being generally the same as the width of said center conductors taken in a direction normal to the direction of extension of said center conductors.

2. An antenna as claimed in claim 1, wherein the antenna is accommodated in a housing having a conductive base forming said lower ground plane member.

3. An antenna as claimed in claim 1, wherein said channels communicate with each of said apertures at a pair of locations spaced about the periphery of each of said apertures and wherein each of said apertures is provided with two orthogonal center conductors and probes at a phase difference of 90°.

4. An antenna as claimed in claim 1, further including a spacer of dielectric material interposed between said layer of conductive material and said lower ground plane member.

5. An antenna as claimed in claim 1, wherein said coplanar waveguide means is further defined as providing one of a right hand or left hand circular polarization to the microwave frequency, electromagnetic radiation, and wherein said antenna further comprises;

a second sheet of dielectric material;

a second layer of conductive material supported by said second sheet of dielectric material;

a second plurality of apertures formed in said second layer of conductive material; and second coplanar waveguide line means electromagnetically coupled to said second plurality of apertures at the microwave operating frequency, said second coplanar waveguide line means comprising at least one second channel communicating with each of said second plurality of apertures, said second channels being formed in said second layer of conductive material, and a second strip-like center conductor located within each of said second channels and extending therealong, said second center conductors extending into said second plurality of apertures and terminating therein at free terminations so that the ends of said second conductors in said second apertures form second excitation probes, the width of said second excitation probes taken in a direction normal to the direction of extension of said second center conductors being generally the same as the width of said second center conductors taken in a direction normal to the direction of extension of said second center conductors, said second coplanar waveguide line means providing the other of said right hand or left hand circular polarization to the microwave frequency, electromagnetic radiation, said second dielectric material sheet, second apertured conductive material layer, and said second coplanar waveguide means being positioned proximate and parallel to said dielectric material sheet, apertured conductive material layer, and coplanar guide means and on the same side of said lower ground plane member, the apertures in said conductive material layer and said second apertures in said second layer of conductive material being in alignment.

6. An antenna as claimed in claim 3, wherein said coplanar waveguide means is further defined as providing one of a right hand or left hand circular polarization to the microwave frequency, electromagnetic radiation, and wherein said antenna further comprises:

a second sheet of dielectric material;

a second layer of conductive material supported by said second sheet of dielectric material;

a second plurality of apertures formed in said second layer of conductive material; and second coplanar waveguide line means electromagnetically coupled to said second plurality of apertures at the microwave operating frequency, said second coplanar waveguide line means comprising at least one second channel communicating with each of said second plurality of apertures, said second channels being formed in said second layer of conductive material, and a second strip-like center conductor located within each of said second channels and extending therealong, said second center conductors extending into said second plurality of apertures and terminating therein at free terminations so that the ends of said second conductors in said second apertures form second excitation probes, the width of said second excitation probes taken in a direction normal to the direction of extension of said second center conductors being generally the same as the width of said second center conductors taken in a direction normal to the direction of extension of said second center conductors, said second coplanar waveguide line means providing the other of said right hand or left hand circular polarization to the microwave frequency, electromagnetic radiation, said second dielectric material sheet, second apertured conductive material layer, and said second coplanar waveguide means being positioned proximate and parallel to said dielectric material sheet, apertured conductive material layer, and coplanar guide means and on the same side of said lower ground plane member, the apertures in said conductive material layer and said second apertures in said second layer of conductive material being in alignment.

7. An antenna as claimed in claim 1, wherein said coplanar waveguide means is further defined as providing a first linear polarization to the microwave frequency, electromagnetic radiation, and wherein said antenna further comprises:

a second sheet of dielectric material;

a second layer of conductive material supported by said second sheet of dielectric material;

a second plurality of apertures formed in said second layer of conductive material; and second coplanar waveguide line means electromagnetically coupled to said second plurality of apertures at the microwave operating frequency, said second coplanar waveguide line means comprising at least one second channel communicating with each of said second plurality of apertures, said second channels being formed in said second layer of conductive material, and a second strip-like center conductor located within each of said second channels and extending therealong, said second center conductors extending into said second plurality of apertures and terminating therein at free terminations so that the ends of said second conductors in said second apertures form second excitation probes, the width of said second excitation probes taken in a direction normal to the direction of extension of said second center conductors being generally the same as the width of said second center conductors taken in a direction normal to the direction of extension of said second center conductors, said second coplanar waveguide line means providing a second linear polarization to the microwave frequency, electromagnetic radiation, said second dielectric material sheet, second apertured conductive material layer, and said second coplanar waveguide means being positioned proximate and parallel to said dielectric material sheet, apertured conductive material layer, and coplanar guide means and on the same side of said lower ground plane member, the apertures in said conductive material layers being in alignment for generating orthogonal linear polarizations to the electromagnetic radiation.

8. An antenna as claimed in claim 1, wherein said apertures are disposed in at least one subarray of four apertures, each of said apertures being fed by two orthogonal probes with a phase difference of 90°, the apertures in said subarray being rotated relative to each other by 90°.

9. An antenna as claimed in claim 4, wherein said spacer of dielectric material has grooves therein generally aligned with said center conductors.

10. An antenna as claimed in claim 4, wherein said spacer of dielectric material has cavities therein generally aligned with said apertures.

11. An antenna as claimed in claim 10, further including means interposed between said layer of conductive material and said lower ground plane member for forming cavities, the openings of which are oriented toward said layer of conductive material, said cavities being aligned with, but spaced from, said apertures.

12. An antenna as claimed in claim 11, wherein said cavity forming means comprises a plurality of means each having an edge forming an opening for one of said cavities and wherein the edges of said cavities have indentations generally aligned with said center conductors.

13. An antenna as claimed in claim 4, further including means in said dielectric material spacer for forming cavities, the openings of which are oriented toward said layer of conductive material, said cavities being aligned with, but spaced from, said apertures.

14. An antenna as claimed in claim 11, further including second means for forming cavities, said second means being positioned on the opposite side of said layer of conductive material from said means for forming cavities, the cavities in said second means having openings which are oriented toward said layer of conductive material, said cavities being aligned with, but spaced from, said apertures.

15. An antenna according to claim 1, wherein each of said apertures has a single center conductor extending into said aperture along a line passing across said aperture, and wherein said aperture has a bar of electrically conductive material associated therewith and positioned generally centrally with respect thereto, said bar lying at a 45° angle with respect to the line of extension of said center conductor.

16. An antenna according to claim 1, wherein each of said apertures has a single center conductor extending into said aperture along a line extending across said aperture, and wherein said aperture has a pair of opposing bars of electrically conductive material associated therewith extending inwardly from the periphery of said aperture, said bars lying at a 45° angle with respect to the line of extension of said center conductor.

17. An antenna according to claim 1, wherein each of said apertures has a single center conductor extending into said aperture along a line passing across the aperture and wherein said aperture is symmetrically shaped with respect to the line of extension of said center conductor.

18. An antenna according to claim 1, wherein each of said apertures has a single center conductor extending into said aperture along a line passing across the aperture and wherein said aperture is asymmetrically shaped with respect to the line of extension of said center conductor.

19. An antenna according to claim 11 wherein said cavity forming means includes a plurality of intersecting septa for forming said cavities.

* * * * *